United States Patent [19]

Rodgers

[11] 4,104,822

[45] Aug. 8, 1978

[54] ROTATING CIRCULAR AIRFOIL

[76] Inventor: Henry Wendell Rodgers, 9725 W. 21st Ave., Lakewood, Colo. 80215

[21] Appl. No.: 747,310

[22] Filed: Dec. 3, 1976

[51] Int. Cl.[2] ..... A63H 27/00

[52] U.S. Cl. ..... 46/74 D; 273/106 B

[58] Field of Search ..... 46/74 R, 74 D; 273/106 R, 106 B

[56] References Cited

U.S. PATENT DOCUMENTS

| | | | |
|---|---|---|---|
| 3,580,580 | 5/1971 | Wark | 46/74 D |
| 3,594,945 | 7/1971 | Turney | 46/74 D |
| 3,673,731 | 7/1972 | Farhi | 46/74 D |
| 3,765,122 | 10/1973 | English | 46/74 D |
| 3,840,233 | 10/1974 | Patterson | 273/106 R |

*Primary Examiner*—Russell R. Kinsey
*Assistant Examiner*—Robert F. Cutting

[57] ABSTRACT

A rotating aerial device intended for use as a toy has a circular ring having a cross-sectional configuration of an airfoil. The airfoil is defined by an outer circumferential edge and an inner circumferential edge which define the extremeties of a chord line of the airfoil cross-section. The airfoil cross-section also includes a top camber, a bottom camber, and a body thickness.

14 Claims, 3 Drawing Figures

SECTION A-A

ROTATING CIRCULAR AIRFOIL

BACKGROUND OF THE INVENTION

1. Field of Invention

Rotating, disc-like devices have become extremely popular in recent years as toys, games, and objects to be thrown or tossed and caught between individuals for sport, either organized or unorganized.

2. Prior Art

The prior art in the area of such rotating, disc-like objects includes solid circular devices, usually curved and having a lip of some description at the periphery of such disc. The prior art also includes discs having open centers constructed of a series of annular ring sections of varying dimensions and angles. Examples of such ring-like devices are disclosed in U.S. Pat. Nos. 3,765,122 to English, 3,673,732 to Liotta and 3,580,580 to Wark. All of these devices are either difficult to maniuplate, have extremely limited flight range, or both.

BRIEF DESCRIPTION OF THE INVENTION

The present invention is directed toward a lightweight, inexpensive, long-range rotating aerial device for use primarily as a toy, a game, or a recreational device. The rotating aerial device of the present invention incorporates and utilizes airfoil characteristics of the device in accomplishing desired flight patters of the device, ease of operation, and distance of flight.

For the purposes of this disclosure, an airfoil is defined as a device designed for travel through a body of air or other gaseous fluid having a curved upper surface and a curved lower surface for interaction with the body of air or other gaseous fluid to create lift.

While previous devices have utilized concepts of drag to prevent the sinking of the trailing edge of such rotating devices, thereby requiring the inclusion on the device of a downwardly protruding skirt or flange, the circular device of the present invention relies primarily on airfoil lift characteristics and rotational gyroscopic effects to create a long range, easily operated aerial device. The rotating aerial device of the present invention comprises a circular ring having an outer circumferential edge and an inner circumferential edge and a ring body defined by the outer circumferential edge and the inner circumferential edge. The ring body comprises a circular airfoil which, in cross-section, includes a chord line extending across the cross-section from the outer circumferential edge to the inner circumferential edge. The cross-section of the airfoil is defined by a chord line extending from the outer circumferential edge to the inner circumferential edge and further includes a curved top camber surface and a curved bottom camber surface. The top camber surface comprises a substantially uniform curve from the outer circumferential edge to the inner circumferential edge, the maximum height of which is located at approximately equal distances between the edges.

The symmetrical nature of the curvature of the upper camber, as above described, provides an airfoil configuration particularly adapted for a rotating device. As the device of the present invention rotates about its axis in flight, essentially, two airfoil profiles are encountering the body of air or gaseous fluid at any one time, as will be described in more detail later. As will also be further described, the leading edge for one such airfoil profile subsequently becomes the trailing edge for the second airfoil profile and, likewise, the trailing edge of the first airfoil profile subsequently becomes the leading edge of the second airfoil profile. Therefore, the symmetry of curvature of the airfoil profile, as briefly described above, is extremely significant to the proper operation of the rotating aerial device described herein.

In addition, the rotational movement of the aerial device of the present invention creates a gyroscopic effect which significantly stablizes the flight of the rotating aerial device of the present invention, thereby inhancing the ease of operation as well as the distance of flight of the rotating aerial device described herein.

OBJECTS OF THE INVENTION

An object of the present invention is to provide a long-range, easily operated, rotating aerial device for use as a toy, a game or recreational device.

A further object of the present invention is to provide a rotating aerial device having a ring-like body comprising a continuous airfoil.

A further object of the present invention is to provide a rotating aerial device incorporating gyroscopic principles to assist in maintaining the stability of the aerial device as well as desired lift.

DETAILED DESCRIPTION OF THE INVENTION

The most common rotating aerial device for use as a toy, a game, or recreational device comprises a solid circular disc curved at its edges downwardly to form a downwardly and inwardly extending lip or skirt completely surrounding the disc-like device. This device, while experiencing considerable market success, is difficult to operate, particularly for those persons with limited dexterity, such as, for example, younger children. The weight of the device, in addition to its configuration, makes the device difficult to manipulate. Further, as a result of the configuration of the device, any slight deviation from a planer orientation of the device in the process of launching the device will cause the device to dip erratically and fall to the ground. A person tossing the device of the present invention, with a slight flip of the wrist to impart rotational movement thereto and with the leading edge raised slightly in relation to the trailing edge, has full benefit of the airfoil contours of the ring-like body of the device enabling that person to toss the device a considerable distance with minimum effort. Likewise, the stability imparted to the device as a result of the airfoil characteristics thereof overcome slight deviations from a planer attitude of the device to allow a less than expert toss to lauch the device into successful flight for the enjoyment of a broader range of personal skills in the operation of such a device.

Figure 1:
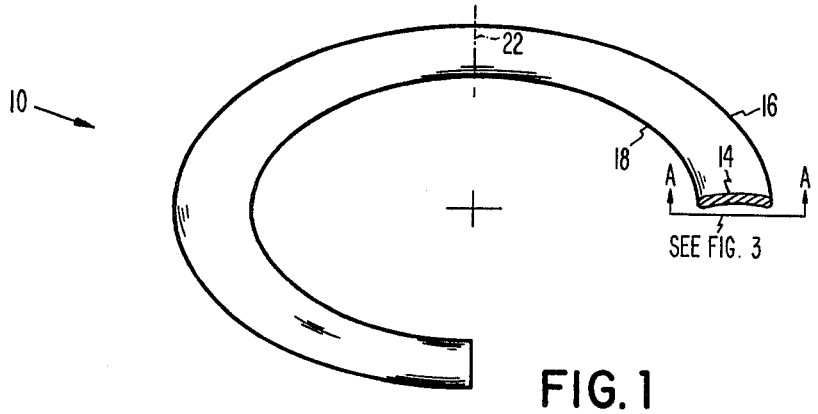
FIG. 1 is an isometric view of the aerial device of the present invention.
Figure 2:
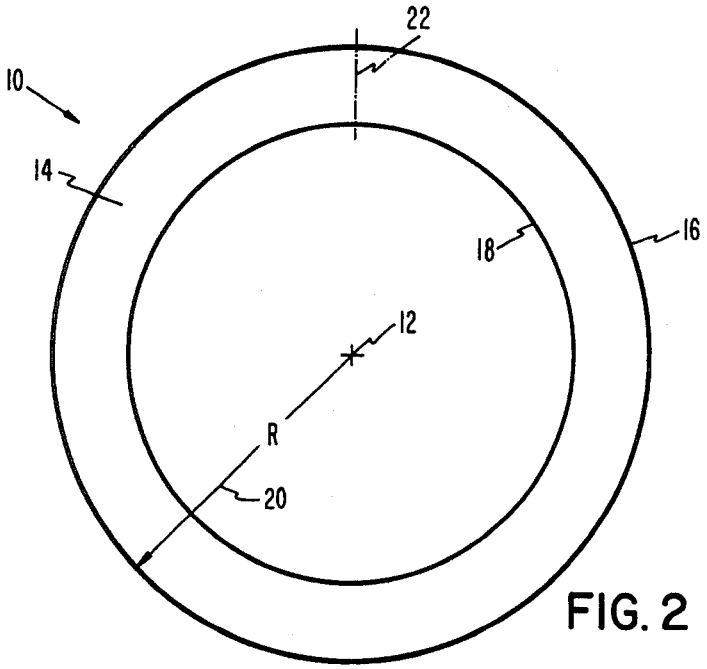
FIG. 2 is a top view of the aerial device of the present invention.

As seen in FIGS. 1 and 2, the rotating aerial device of the present invention constitutes a circular ring-like device 10 which rotates about an axis 12 generally perpendicular to the body of the aerial device 10. The aerial device 10 comprises a ring-like body 14 bounded by an outer circumferential edge 16 and an inner circumferential edge 18. A radius 20 of the aerial device 10 may be an essentially unlimited dimension, as will be more fully described later.

Figure 3:
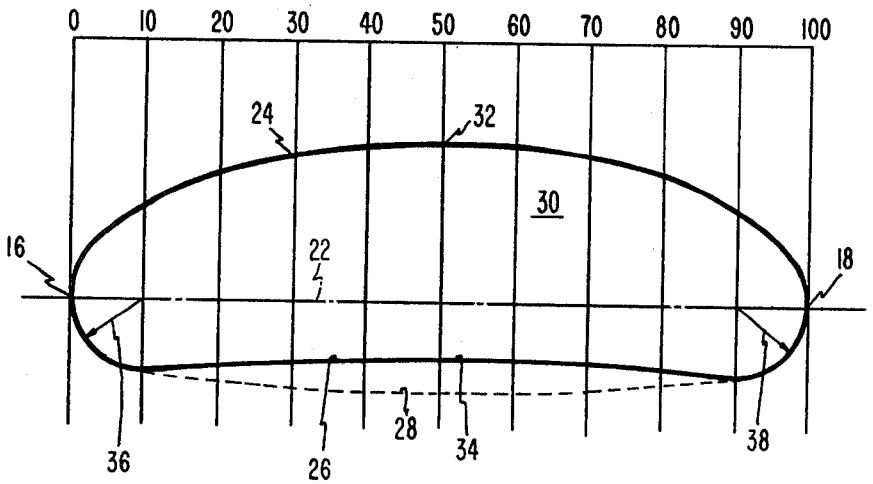
FIG. 3 is a partial cross-section of the device of the present invention taken along section AA of FIG. 1.

FIG. 3 is a partial cross-section taken along section AA of FIG. 1. As seen in FIG. 2, a cross-section of the ring body 14 takes on a configuration of an airfoil, as defined above, similar to an airfoil cross-section of an airplane wing. The outer circumferential edge 16 and the inner circumferential edge 18 define the lateral extremeties of the ring body 14. A chord line 22 extends across the ring body 14 joining the outer circumferential edge 16 and the inner circumferential edge 18. For the purposes of this disclosure, the chord line 22 is defined as a lateral line of reference joining the two lateral extremeties of an airfoil cross-section.

Ring body 14 further comprises an upper camber surface 24 and a lower camber surface 26. Upper camber surface 24 constitutes a convexly curved surface positioned above the chord line 22 and joining the outer circumferential edge 16 and the inner circumferential edge 18. The upper camber surface 24 curves upward from the chord line 22 uniformally from both the outer circumferential edge 16 and the inner circumferential edge 18 to a maximum point 32 equal distance between the outer circumferential edge 16 and the inner circumferential edge 18. The uniformity of the curvature of the upper camber surface 24 is a significant aspect of the present invention. As the aerial device 10 travels through a body of air or other gaseous fluid rotating about its axis 12, a point on the outer circumferential edge 16 will be acting as a leading edge of the aerial device 10 while at the same time a point on the inner circumferential edge 18 separated from the outer circumferential edge 16 by the chord line 22 will be acting as a trailing edge. However, upon rotation of the aerial device 10 180°, the same point on the inner circumferential edge 16 separated therefrom by the chordline 22 is acting as a trailing edge. The uniformity of curvature of the upper camber surface 24 enables the leading edge to react consistently with the air body, whether that leading edge be the outer circumferential edge 16 or the inner circumferential edge 18, thereby maintaining uniform lift characteristics as will be described in greater detail later.

The lower camber surface 26, as shown, constitutes a positive camber; that is, a curvature in the same direction as the curvature of the upper camber surface 24. Like the upper camber surface 24, the lower camber surface 26 curves uniformally to a maximum point 34 equal distance between the outer circumferential edge 16 and the inner circumferential edge 18. Also contemplated by the present invention is a negative lower camber surface 28 curving in an opposite direction from the curvature of the upper camber surface 24. In this case, again the curvature of the lower camber surface 28 curves uniformally to a minimum point equal distance between the outer circumferential edge 16 and the inner circumferential edge 18. The present invention contemplates, in addition to a positive camber and a negative camber, as described above, a lower camber surface having no curvature, that is, a bottom camber surface parallel with the chord line 22.

While the positive lower camber surface 26 the negative lower camber surface 28 and a camber surface having no curvature are contemplated and within the scope of the present invention, different flight characteristics result depending upon which camber surface is used. The positive lower camber surface 26 is the preferred embodiment of the present invention for the reason that a negative lower camber surface produces less lift than a positive lower camber surface. A camber surface with no curvature reacts more like a positive camber than a negative camber. The greater lift provided by the positive lower camber surface increases the ease of operation of the rotating aerial device 10 and thereby increases the desirability of the device as a toy, game, or recreational device. At no time will the positive lower camber surface 26 as contemplated by the present invention intersect with or cross above the chord line 22. However, it has also been found that a large positive camber, while increasing lift, undesirably limits stability.

Both the outer circumferential edge 16 and the inner circumferential edge 18 are smoothly rounded to continue the convex curvature of the upper camber surface 24 and join the curvature of the lower camber surface 26 or 28. The outer circumferential edge 16 and the inner circumferential edge 18 include a radius of curvature 36 and 38 appropriately chosen to continue the curvatures above described. Additionally, the rounded circumferential edges 16 and 18 aid in the flight characteristics of the airfoil design, as will be described in more detail later and also provide a blunt edge so as to minimize injury or damage when the rotating aerial device 10 is either caught by another person or collides with another object.

As stated previously, the high point 32 of the upper camber surface 24 extends above the chord line 22 and the high point 34 of the lower camber surface 26 at no time extends above the chord line 22. Consequently, the ring body 14 is of significant thickness, as measured perpendicular to the chord line 22. The thickness of the ring body 14 will be defined as the maximum distance between points on the upper camber surface 24 and the lower camber surface 26, as measured perpendicularly to the chord line 22. As a result of the symmetrical curvature of the upper camber surface 24 and the lower camber surface 26, as previously described, the maximum thickness will occur equal distance between the outer circumferential edge 16 and the inner circumferential edge 18, or at points 32 and 34. Although the precise body thickness, as measured in inches, centimeters, or other finite measurements, is not significant to the present invention, the relationship between the body thickness and the length of chord line 22 has been found to be significant. It has been found that, for optimum effectiveness of the rotating aerial device 10 incorporating airfoil principles, the relationship of the body thickness to the length of chord line 22 is within the range of $\frac{1}{8}$ to $\frac{3}{8}$ times the length of chord line 22. More preferably, the body thickness is $\frac{1}{4}$ times the length of the chord line 22.

The ring body 14 of the rotating aerial device 10 may be constructed of a variety of materials, which materials combine strength and rigidity with lightness. Some preferred materials for use in the construction of the present invention include plastic, wood, foamed plastics, rubber, wood fibers, wood pulp and paper products. Although the preceeding materials have been named, any similar material providing a combination of strength, rigidity and lightness are contemplated by the present invention. If the material chosen is plastic, the present invention likewise contemplates increasing the density of that plastic to provide additional strength and rigidity and at the same time remaining lightweight by constructing the ring body 14 with a hollow core.

It is further contemplated, that if the material utilized in the construction of the present device is foamed plastic, a skin of foamed plastic having a signifiantly greater density than that making up the ring body 14 of the device may be included to insure strength and rigidity. This embodiment also provides resiliency to the present device which also minimizes injury or damage to persons or property.

As previously stated, the rotating aerial device 10 of the present invention should be lightweight in relation to the size of the device. It has been determined in the present invention that the optimum relationship between the surface area of a plane created by the chord line 22 and the weight of the rotating aerial device 10 is within the range of 20 square inches to 100 square inches per ounce. More preferably, the relationship of the surface area of the upper camber surface 24 to the weight of the device is approximately 40 square inches per ounce.

Referring now to both FIGS. 1 and 2, as previously stated, a precise denominational limitation on the radius 20 of the rotating aerial device 10 is not contemplated by the present invention. The radius 20 may have any dimension, large or small, within reason. The relationship of the radius 20 with the length of the chord line 22, however, has been found to be significant to the optimum utilization of the rotating aerial device 10. It has been found that for best results, the radius 20 is at least approximately 2 times the length of the chord line 22. More preferably, the radius 20 is approximately 3.7 times the length of the chord line 22.

Referring further to FIG. 3, a preferred embodiment would have the following dimensions as specified in the chart of chart A, below.

CHART A

| | SEGMENT | | | | | | | | |
|---|---|---|---|---|---|---|---|---|---|
| | 10 | 20 | 30 | 40 | 50 | 60 | 70 | 80 | 90 |
| Dimension chord line to upper surface | .13 | .17 | .19 | .205 | .21 | .205 | .19 | .17 | .13 |
| Dimension chord line to lower surface | .095 | .085 | .08 | .0775 | .075 | .0775 | .08 | .085 | .095 |

In operation, the rotating aerial device 10 of the present invention operates as a rotating airfoil, combining both the aerodynamic features of an airfoil as it travels through a body of air or other gaseous liquid with a rotational effect of a rotating device. The rotating aerial device 10 is launched with a slight flip of the wrist and arm to impart rotational motion to the rotating aerial device 10 about its axis 12. The device is launched with a slight angle of attack, that is, the leading edge of the device is slightly higher than the trailing edge of the device as it leaves the hand of the person throwing the device. As such, the outer circumferential edge 16 enters an airstream and directs a portion of that stream over the top camber surface 24 and another portion under the bottom camber surface 26 creating lift. When viewing the device in flight, if the rotary motion of the device were stopped at any time, one will note that effectively two airfoils confront the airstream at any one time, a leading airfoil and a trailing airfoil. In the same manner that the airstream contacts the outer perifeeral edge 16 of the rotating device in the leading airfoil, the airstream also contacts the inner circumferential edge 18 of the trailing airfoil, which at that point is acting as a leading edge and directs the airstream both over the upper camber surface 24 and under the lower or bottom camber surface 26. In this manner, the airfoil configuration of the present device provides lift not only to the leading portion of the device but also to the trailing portion of the device. Consequently, it is not necessary to provide any type of a downwardly projecting lip or skirt to provide lift to the trailing portion of the rotating device and therefor no drag is created by such lip or skirt which would interfere with the flight distance of the device in question.

The rotating motion of the device provides stability to the rotating aerial device 10 in flight as a result of the gyroscopic effect of the rotating ring body 14. At the same time, however, it has been found that the combined effect of the rotating motion and the forward motion of the device 10 creates greater lift on one side of the ring body 14 than on the other side of the ring body 14, depending upon the direction of rotation. A large positive curvature of the bottom camber surface 26, using positive curvature as above described, increases the lift characteristic of the airfoil in question, but as a result of the unstable lift created by the rotating device described immediately above, a large positive curvature of the bottom camber surface 26 is not desirable. It has been found that by limiting such increased lift characteristics by controlling the degree of camber, the stabilizing gyroscopic effect is preserved, thereby limiting the possibility that such a rotating device will roll to one side or the other and fall to the ground.

It is further contemplated that the device of the present invention may be used with an aircraft or aircraft wing to impart added stability thereto.

What is claimed is:

1. A rotating aerial device for use as a toy comprising a circular ring having an outer circumferential edge and an inner circumferential edge and a ring body defined by said outer circumferential edge and said inner circumferential edge wherein said ring body comprises:

a. a circular airfoil having an upper camber surface and a bottom camber surface and a uniform cross-section throughout and;

b. at any cross-section of said airfoil said bottom camber surface is below a reference chord line extending across said cross-section from said outer circumferential edge to said inner circumferential edge; and c. said upper camber surface is above said chord line having a maximum height from said chord line approximately equal distance between said outer circumferential edge and said inner circumferential edge; and d. a first curvature of said upper camber from said maximum height to said outer circumferential edge substantially identical to a second curvature of said upper camber from said maximum height to said inner circumferential edge.

2. A rotating aerial device as claimed in claim 1, wherein:

a. said bottom camber surface has a positive camber in the same direction as said upper camber surface; and b. a maximum height of said bottom camber surface remains below said chord line.

3. A rotating aerial device as claimed in claim 1, wherein said bottom camber surface has a negative camber in the opposite direction from said upper camber surface.

4. A rotating areal device as claimed in claim 1, wherein said bottom camber surface is generally parallel with said chord line.

5. A rotating aerial device as claimed in claim 1, wherein a radius from a center of said rotating aerial device to said outer circumferential edge is at least 2 times the length of said chord line.

6. A rotating aerial device as claimed in claim 5, wherein said radius is 3.7 times the length of said chord line.

7. A rotating aerial device as claimed in claim 1, wherein a plane created by said chord line comprises a surface area within the range of 20 square inches to 100 square inches per ounce of weight of said rotating aerial device.

8. A rotating aerial device as claimed in claim 7, wherein said surface area of said plane created by said chord line is 40 square inches per ounce of weight of said rotating aerial device.

9. A rotating aerial device as claimed in claim 1, wherein a body thickness of said ring body as measured from said upper camber surface to said bottom camber surface at a point approximately equal distance from said outer circumferential edge to said inner circumferential edge is within the range of from $\frac{1}{8}$ to $\frac{3}{8}$ times the length of said chord line.

10. A rotating aerial device as claimed in claim 9, wherein said body thickness is $\frac{1}{4}$ times said length of said chord line.

11. A rotating aerial device as claimed in claim 1, wherein said outer circumferential edge and said inner circumferential edge are rounded and have equal radii from a center point on said chord line.

12. A rotating aerial device as claimed in claim 1 wherein said ring body is constructed of wood, plastic, foamed plastic, rubber, wood fibers, wood pulp or paper products.

13. A rotating aerial device as claimed in claim 12 wherein said ring body is constructed of plastic and includes a hollow core.

14. A rotating aerial device as claimed in claim 12 wherein said ring body is constructed of foamed plastic and includes a foamed plastic skin having a density greater than that of foamed plastic body.

* * * * *

REEXAMINATION CERTIFICATE (582nd)

United States Patent [19] [11] B1 4,104,822

Rodgers [45] Certificate Issued Oct. 14, 1986

[54] ROTATING CIRCULAR AIRFOIL

[76] Inventor: Henry W. Rodgers, 9725 W. 21st Ave., Lakewood, Colo. 80215

Reexamination Request:
No. 90/000,352, Mar. 31, 1983

Reexamination Certificate for:

| | |
|---|---|
| Patent No.: | **4,104,822** |
| Issued: | **Aug. 8, 1978** |
| Appl. No.: | **747,310** |
| Filed: | **Dec. 3, 1976** |

[51] Int. Cl.[4] ..... A63H 27/00
[52] U.S. Cl. ..... 446/48; 273/425
[58] Field of Search ..... D21/86; 446/48; 273/425

[56] References Cited

U.S. PATENT DOCUMENTS

| | | | |
|---|---|---|---|
| 248,901 | 11/1881 | Wetherill | 273/106.2 |
| 482,852 | 9/1892 | Stevens . | |
| 532,233 | 1/1895 | Faxon . | |
| 678,265 | 7/1901 | Low | 273/425 |
| 708,519 | 9/1902 | Bradshaw | 273/106 |
| 1,986,937 | 9/1932 | MacGregor | 273/106 |
| 1,991,689 | 6/1932 | McClintock | 29/156 |
| 3,082,572 | 10/1961 | Knox | 46/82 |
| 3,467,385 | 10/1965 | Liston | 273/106 |
| 3,565,434 | 2/1971 | Liston | 273/106 |
| 3,590,518 | 7/1971 | LeBaron | 46/81 |

FOREIGN PATENT DOCUMENTS 13768 10/1984 United Kingdom .

OTHER PUBLICATIONS

Catalog, Snow Foam Products, Inc. catalog No. 57, p. 1-s, 1957.
Catalog, The Snow Foam Fall Catalog 1973, p. 13, Snow Foam Products, Inc.
Catalog, The Snow Foam 1982 Catalog, p. 20, Snow Foam Products, Inc.

*Primary Examiner*—F. Barry Shay

[57] ABSTRACT

A rotating aerial device intended for use as a toy has a circular ring having a cross-sectional configuration of an airfoil. The airfoil is defined by an outer circumferential edge and an inner circumferential edge which define the extremeties of a chord line of the airfoil cross-section. The airfoil cross-section also includes a top camber, a bottom camber, and a body thickness.

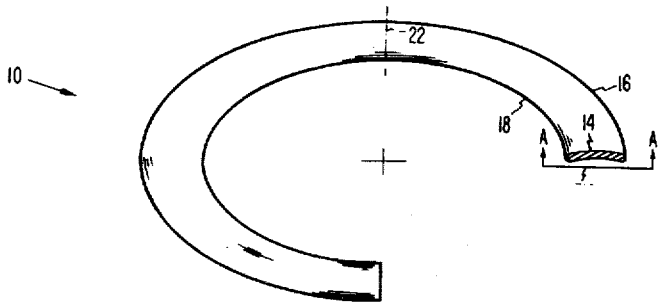

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2, 4, 6–11 and 14 is confirmed.

Claims 1, 3, 5, 12 and 13 are cancelled.

New claims 15–24 are added and determined to be patentable.

*15. A rotating circular ring airfoil body for use as a flying toy, which airfoil body is defined by an outer circumferential edge and an inner circumferential edge and an upper camber surface and a bottom camber surface, said edges and surfaces defining an airfoil profile in cross section radially through said airfoil body, said airfoil profile being of uniform cross sectional configuration circumferentially around said airfoil body, said airfoil profile being further defined with respect to a reference chord line extending across said profile from said outer circumferential edge to said inner circumferential edge, said upper camber surface is located above said chord line and has a maximum height above said chord line at approximately equal distance between said outer circumferential edge and said inner circumferential edge, said bottom camber surface is located below and extends generally parallel with respect to said chord line, said upper camber surface has a first curvature from said maximum height to said outer circumferential edge and a second curvature from said maximum height to said inner circumferential edge, and said first and second curvatures are substantially identical to one another and symmetrical about a reference line perpendicular to said chord line and passing through a midpoint of said chord line.*

*16. A rotating circular airfoil body as claimed in claim 15, wherein a radius from a center of said rotating circular airfoil to said outer circumferential edge is 3.7 times the length of said chord line.*

*17. A rotating circular airfoil body as claimed in claim 15, wherein a plane created by said chord line comprises a surface area within the range of 20 square inches to 100 square inches per ounce of weight of said rotating circular airfoil.*

*18. A rotating circular airfoil body as claimed in claim 17, wherein said surface area of said plane created by said chord line is 40 square inches per ounce of weight of said rotating circular airfoil.*

*19. A rotating circular airfoil body as claimed in claim 15, wherein a body thickness of airfoil body as measured from said upper camber surface to said bottom camber surface at a point approximately equal distance from said outer circumferential edge to said inner circumferential edge is within the range of from $\frac{1}{8}$ to $\frac{3}{8}$ times the length of said chord line.*

*20. A rotating circular airfoil body as claimed in claim 19, wherein said body thickness is one quarter times said length of said chord line.*

*21. A rotating circular airfoil body as claimed in claim 15, wherein said outer circumferential edge and said inner circumferential edge are rounded and have equal radii from said midpoint on said chord line.*

*22. A rotating circular airfoil body as claimed in claim 15, wherein said airfoil body is constructed of foamed plastic and includes a foamed plastic skin having a density greater than that of a foamed plastic body.*

*23. A rotating circular ring airfoil body for use as a flying toy, which airfoil body is defined by an outer circumferential edge and an inner circumferential edge and an upper camber surface and a bottom camber surface, said edges and surfaces defining an airfoil profile in cross section radially through said airfoil body, said airfoil profile being of uniform cross sectional configuration circumferentially around said airfoil body, said airfoil profile being further defined with respect to a reference chord line extending across said profile from said outer circumferential edge to said inner circumferential edge, said upper camber surface is located above said chord line and has a maximum height above said chord line at approximately equal distance between said outer circumferential edge and said inner circumferential edge, said bottom camber surface has a maximum height located below said chord line and has a positive camber in the same direction as said upper camber surface, said upper camber surface has a first curvature from said maximum height to said outer circumferential edge and a second curvature from said maximum height to said inner circumferential edge, and said first and second curvatures are substantially identical to one another and symmetrical about a reference line perpendicular to said chord line and passing through a midpoint of said chord line.*

*24. A rotating circular ring airfoil body for use as a flying toy, which airfoil body is defined by an outer circumferential edge and an inner circumferential edge and an upper camber surface and a bottom camber surface, said edges and surfaces defining an airfoil profile in cross section radially through said airfoil body, said airfoil profile being of uniform cross sectional configuration circumferentially around said airfoil body, said airfoil profile being further defined with respect to a reference chord line extending across said profile from said outer circumferential edge to said inner circumferential edge, said upper camber surface is located above said chord line and has a maximum height above said chord line at approximately equal distance between said outer circumferential edge and said inner circumferential edge, said bottom camber surface has a maximum height located below said chord line, which maximum height is nearer said chord line than the maximum height of said upper camber surface, said upper camber surface has a first curvature from said maximum height to said outer circumferential edge and a second curvature from said maximum height to said inner circumferential edge, and said first and second curvatures are substantially identical to one another and symmetrical about a reference line perpendicular to said chord line and passing through a midpoint of said chord line.*

* * * * *

REEXAMINATION CERTIFICATE (1084th)

United States Patent [19]

Rodgers

[11] B2 4,104,822

[45] Certificate Issued Jun. 27, 1989

[54] ROTATING CIRCULAR AIRFOIL

[76] Inventor: Henry W. Rodgers, 9725 W. 21st Ave., Lakewood, Colo. 80215

Reexamination Request:
No. 90/001,118, Oct. 23, 1986

Reexamination Certificate for:

| | |
|---|---|
| Patent No.: | **4,104,822** |
| Issued: | **Aug. 8, 1978** |
| Appl. No.: | **747,310** |
| Filed: | **Dec. 3, 1976** |

Reexamination Certificate B1 4,104,822 issued Oct. 14, 1986.

[51] Int. Cl.[4] ..... A63H 27/00

[52] U.S. Cl. ..... 446/48; 273/425

[58] Field of Search ..... 446/46, 47, 48, 61; D21/86, 85, 2, 4; 273/425, 426, 424, 428; 244/16, 34 A, 39, 123

[56] References Cited

U.S. PATENT DOCUMENTS

| | | | |
|---|---|---|---|
| D. 214,577 | 7/1969 | Mueller | D21/85 |
| 248,901 | 11/1881 | Wetherill | 273/425 |
| 482,852 | 9/1892 | Stevens | 273/426 |
| 532,233 | 1/1895 | Faxon | 273/426 |
| 678,265 | 7/1901 | Low | 273/425 |
| 708,519 | 9/1902 | Bradshaw | 273/425 |
| 1,786,017 | 12/1930 | Matta | 244/23 C |
| 1,986,937 | 1/1935 | MacGregor | 273/425 |
| 1,991,689 | 2/1935 | McClintock | 273/425 X |
| 2,547,266 | 4/1951 | Hoglin | 244/12.2 |
| 2,640,699 | 6/1953 | Garbo | 273/424 |
| 2,659,178 | 11/1953 | Van Hartesvelt | 446/46 |
| 2,807,428 | 9/1957 | Wibault | 244/23 C |
| 2,876,964 | 3/1959 | Streib | 244/12.2 |
| 3,055,613 | 9/1962 | Taylor | 244/12.2 |
| 3,082,572 | 3/1963 | Knox, Jr. | 446/46 |
| 3,104,853 | 9/1963 | Klein | 244/12.2 |
| 3,181,811 | 5/1965 | Maksim, Jr. | 244/12.2 |
| 3,220,142 | 11/1965 | Butterfield | 446/46 |
| 3,312,472 | 4/1967 | Kerr | 446/48 X |
| 3,359,678 | 12/1967 | Headrick | 446/46 |
| 3,525,484 | 8/1970 | Mueller | 244/12.2 |
| 3,565,434 | 2/1971 | Liston | 273/426 |
| 3,572,613 | 3/1971 | Porter | 244/12.2 |
| 3,580,580 | 5/1971 | Wark | 446/48 X |
| 3,590,518 | 7/1971 | Lebaron | 273/425 X |
| 3,594,945 | 7/1971 | Turney | 446/48 |
| 3,673,731 | 7/1972 | Farhi et al. | 446/46 |
| 3,673,732 | 7/1972 | Liotta | 446/46 |
| 3,710,505 | 1/1973 | Linenfelser | 446/46 |
| 3,742,643 | 7/1973 | Keith | 446/46 |
| 3,765,122 | 10/1973 | English | 446/48 |
| 3,802,704 | 4/1974 | Genua | 273/336 |
| 3,828,466 | 8/1974 | Geiger | 446/48 |
| 3,840,233 | 10/1974 | Patterson | 273/428 |

FOREIGN PATENT DOCUMENTS

| | | | |
|---|---|---|---|
| 13768 | of 1884 | United Kingdom . | |
| 18716 | of 1902 | United Kingdom | 273/425 |

OTHER PUBLICATIONS

Book, F. W. Lanchester, *Aerodonetics*, Archibald Constable & Co. Ltd., London, pp. 13–15, 318–322, 374–382, and 400–414, 1908.

Book, G. P. Thomson, *Applied Aerodynamics*, Hodder and Stoughton, London, p. 82, 1919.

Book, S. T. G. Andrews and S. F. Benson, *The Theory & Practice of Aeroplane Design, E. P. Dutton, New York, pp. 71–73, 1920.*

Book, C. C. Carter, *Simple Aerodynamics and The Airplane*, The Ronald Press Co., New York, pp. 48–49, 1929.

Article, G. P. Herrick, "*Some Aerodynamic Problems in the Design of the Convertible Airplane*," Journal of the Aeronautical Sciences, vol. 5, No. 12, pp. 494–497, Oct. 1938.

Book, I. H. Abbott & A. E. Von Doenhoff, *Theory of Wing Sections*, Dover Publications, New York, pp. 233, 317, 326, 327, 371, 449–451, 483, 485, 487, 1959.

Book, S. F. Hoerner, *Fluid-Dynamic Drag*, published by the author, pp. 5–10, 5–11, 6–1, 1965.

F. Hess, "*The Aerodynamics of Boomerangs*", Scientific American, pp. 124–136, Blank, 1968.

Book, H. G. McEntee, *The Model Aircraft Handbook*, Thomas Y. Crowell Co., New York, pp. 9–24, 1968.

Book, W. P. Spence, *Drafting Technology and Practice*, Chas. A. Bennett Co., Inc., Peroria, Ill., pp. 394–432, 1973.

Book, A. Jordanoff, "*Jordanoff's Illustrated Aviation Dictionary*", Harper & Brothers, New York, pp. 4, 9, 12, 35, 39, 83, 93, 96, 188, 214, 273, 353, 383, 385 and 386, 1942.

Report to Office of Naval Research, R. E. Walters, D. P. Myer & D. J. Holt, "Circulation Control by Steady and Pulsed Blowing From a Cambered Elliptical Airfoil", Aerospace Engineering Report TR-31 under contract No. 0014-68-A-0512, pp. 28–31, 34 & 35, 1972.

Book, Cassell & Co., Ltd., *Cassell's Book of Sports and Pastimes*, London & New York, pp. 327–328, 816–817, 1911.

Book, A. W. Judge, *The Properties of Aerofoils and Aerodynamic Bodies*, James Selwyn & Co., Ltd., London, pp. 64, 100–103, 1917.

ARC R&M No. 2301, D. H. Williams, A. F. Brown and C. J. W. Milles, "Tests on Four Circular Back Airfoils in the Compressed Air Tunnel", Aeronautical Research Council, 1946.

Book, O. G. Tietjens, *Applied Hydro and Aeromechanics*, Dover Pub., Inc., N.Y., NY., pp. 144, 145, 151 & 152, 1934 & 1957.

Book, R. Humphrey, *Jugglig for Fun and Entertainment*, Charles E. Tuttle Co., Rutland, Vermont, pp. 48, 49, 1967.

Book, Carlo, *The Juggling Book*, Vintage Books, New York, pp. 78 and 79, 1974.

Book, S. E. D. Johnson, *Frisbee*, Workman Publishing Co., New York, pp. 40–41, 64, 170–173 and 198–201, 1975.

Book, S. F. Hoerner and H. V. Borst, *Fluid-Dynamic Lift*, Mrs. Liselotte A. Hoerner, pp. 2–6 through 2–8, 17–8 and 21–5, 1975.

Book, *Encyclopedia Britannica* 1911 Edition, p. 763.
Report, W. L. Cowley and H. Levy, "*Interfoils for Airscrew Design*", pp. 277–278, Figs. 1 & 14, 1917.

*Primary Examiner*—Mickey Yu

[57] ABSTRACT

A rotating aerial device intended for use as a toy has a circular ring having a cross-sectional configuration of an airfoil. The airfoil is defined by an outer circumferential edge and an inner circumferential edge which define the extremeties of a chord line of the airfoil cross-section. The airfoil cross-section also includes a top camber, a bottom camber, and a body thickness.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 2, 4, 6–11 and 14–24 is confirmed.

Claims 1, 3, 5, 12 and 13 were previously cancelled.

* * * * *

US004104822B1

REEXAMINATION CERTIFICATE (2119th)

United States Patent [19]

Rodgers

[11] B3 4,104,822

[45] Certificate Issued Nov. 2, 1993

[54] ROTATING CIRCULAR AIRFOIL

[76] Inventor: Henry W. Rodgers, 9725 W. 21st Ave., Lakewood, Colo. 80215

Reexamination Request:
No. 90/001,884, Nov. 1, 1989

Reexamination Certificate for:
Patent No.: 4,104,822
Issued: Aug. 8, 1978
Appl. No.: 747,310
Filed: Dec. 3, 1976

Reexamination Certificate B2 4,104,822 issued Oct. 14, 1986.

Reexamination Certificate B1 4,104,822 issued Jun. 27, 1989.

[51] Int. Cl.[5] ..... A63H 27/00
[52] U.S. Cl. ..... 446/48; 273/425
[58] Field of Search ..... 446/46–48; 273/425, 426, 424; D21/86, 85

[56] References Cited

U.S. PATENT DOCUMENTS

| | | | |
|---|---|---|---|
| 158,991 | 1/1875 | Smith | 273/337 |
| 248,901 | 11/1881 | Wetherill | 273/425 |
| 482,852 | 9/1892 | Stevens | 273/426 |
| 532,233 | 1/1895 | Faxon | 273/426 |
| 708,519 | 9/1902 | Bradshaw | 273/425 |
| 943,343 | 12/1909 | Ericson | 273/337 |
| 1,036,044 | 8/1912 | Wheeler . | |
| 1,489,550 | 4/1924 | Shaffer | 273/425 |
| 1,547,644 | 7/1925 | Cronstedt | 244/35 R |
| 1,792,015 | 2/1931 | Herrick . | |
| 2,009,252 | 7/1935 | Erickson | 273/337 |
| 3,082,572 | 3/1963 | Knox, Jr. | 446/48 |
| 3,359,678 | 12/1967 | Headrick | 446/46 |
| 3,489,374 | 1/1970 | Morcom | 244/12.2 |
| 3,565,434 | 2/1971 | Liston | 273/426 |
| 3,580,580 | 5/1971 | Wark | 446/48 X |
| 3,590,518 | 7/1971 | LeBaron | 273/425 X |
| 3,594,945 | 7/1971 | Turney | 446/48 |
| 3,710,505 | 1/1973 | Linenfelser | 446/46 |
| 3,765,122 | 10/1973 | English | 446/48 |
| 3,840,233 | 10/1974 | Patterson | 273/428 |

FOREIGN PATENT DOCUMENTS

| | | | |
|---|---|---|---|
| 18154 | of 1914 | United Kingdom | 446/48 |
| 416687 | 9/1934 | United Kingdom . | |

OTHER PUBLICATIONS

Cowley, W. et al., "Aerofoils for Airscrew Design," Reports and Memoranda No. 362, pp. 277–279 and FIGS. 1 and 14, Nov. 1917.

Williams, D. et al., "Tests on Four Circular-back Aerofoils in the Compressed Air Tunnel," Report No. 2301, pp. 1–35, Nat'l Physical Library, Jun. 1946.

NACA Report No. 365, Jul. 1930, Briggs, L. et al.

S. E. D. Johnson; "Frisbee"; Workman Publishing Company, New York, pp. 40–41, 64, 170–173 and 198–201; 1975.

A. Jordanoff; "Jordanoff's Illustrated Aviation Dictionary"; Harper & Brothers, New York, pp. 4, 9, 12, 35, 39, 83, 93, 96, 188, 214, 273, 353, 383, 385, and 386; 1942.

G. P. Herrick; "Some Aerodynamic Problems in the Design of the Convertaplane"; Journal of the Aeronautical Sciences; vol. 5, No. 12, pp. 494–497; Oct. 1938.

Hoerner and Borst; "Fluid-Dynamic Lift"; Hoerner Fluid Dynamics Brick Town, NJ, 1975, pp. 2–2, 2–8, 17–8, 19–12 (all are hypenated page numbers), and Chapter 21—Lift of Blunt Bodies.

1988 Edition The World Book Encyclopedia, Book, "L", p. 333.

1965 Edition Encyclopedia Brittanica, vol. 15, pp. 58-59.

*Primary Examiner*—Mickey Yu

[57] ABSTRACT

A rotating aerial device intented for use as a toy has a circular ring having a cross-sectional configuratiton of an airfoil. The airfoil is defined by an outer circumferential edge and an inner circumferential edge which define the extremities of a chord line of the airfoil cross-section. The airfoil cross-section also includes a top camber, a bottom camber, and a body thickness.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 8, 10, 18 and 20 is confirmed.

Claims 1, 3, 5, 12 and 13 were previously cancelled.

Claims 2, 4, 6, 7, 9, 11, 14–17, 19, 21–24 are cancelled.

* * * * *